United States Patent [19]

Haneda et al.

[11] Patent Number: 4,841,332

[45] **Date of Patent: * Jun. 20, 1989**

[54] TONER CONTROL FOR A DEVELOPER DEVICE

[75] Inventors: Satoshi Haneda; Hisashi Shoji; Seiichiro Hiratsuka, all of Tokyo, Japan

[73] Assignee: Konishiroku Photo Industry Co., Ltd., Tokyo, Japan

[ * ] Notice: The portion of the term of this patent subsequent to Dec. 20, 2005 has been disclaimed.

[21] Appl. No.: 890,787

[22] Filed: Jul. 23, 1986

Related U.S. Application Data

[63] Continuation-in-part of Ser. No. 810,990, Dec. 19, 1985, abandoned, which is a continuation of Ser. No. 703,286, Feb. 20, 1985, abandoned.

[30] Foreign Application Priority Data

Feb. 23, 1984 [JP] Japan ..... 59-31405

[51] Int. Cl.[4] ..... G03G 15/08; G03G 15/09

[52] U.S. Cl. ..... 355/251; 355/265; 430/122; 430/138; 430/108; 430/111

[58] Field of Search ..... 355/3 DD, 14 D, 3 R; 118/657, 658; 430/122, 138, 107, 108, 109, 110, 111

[56] References Cited

U.S. PATENT DOCUMENTS

| | | | |
|---|---|---|---|
| 3,879,737 | 4/1975 | Lunde | 355/3 DD X |
| 4,030,447 | 6/1977 | Takahashi et al. | 355/3 DD X |
| 4,350,440 | 9/1982 | Watanabe | 355/3 DD |
| 4,498,756 | 2/1985 | Hosoya et al. | 355/3 DD |
| 4,504,136 | 3/1985 | Yoshikawa et al. | 355/3 DD |
| 4,538,898 | 9/1985 | Kanno et al. | 355/3 DD |

*Primary Examiner*—A. C. Prescott

*Attorney, Agent, or Firm*—Jordan B. Bierman

[57] ABSTRACT

A developing device using an oscillatory electric field and using magnetic poles kept away from a position where the developing sleeve is closest to the image forming member, applying a horizontal magnetic field component to the developer layer and using a pressure member before the transfer gap to establish a layer thickness of the developer layer.

26 Claims, 2 Drawing Sheets

TONER CONTROL FOR A DEVELOPER DEVICE

This application is a continuation-in-part of application Ser. No. 810,990, filed Dec. 19, 1985, now abandoned, which, in turn, is a continuation of application Ser. No. 703,286 filed Feb. 20, 1985 now abandoned.

BACKGROUND OF THE INVENTION

1. Field of the Invention

This invention relates to an improved developing device to be used in an electrophotographic copying machine, a facsimile machine, and the like. More particularly, this invention relates to an improved developing device by which a latent image registered on an image forming member is developed in such a manner that a two-component-type developer comprising toners and magnetic carriers mixed up each other is used, and a developing sleeve facing the surface of the image forming member is revolved, and magnetic poles are fixed to the inside of the developing sleeve, and a layer of the developer is so formed over the developing sleeve as to be moved as the sleeve is revolved, and a latent image on the image forming member can be developed by the developer layer under the circumstances of oscillatory electric field.

2. Description of the Prior Art

The two-component type developers comprising toners and magnetic carriers mixed with each other have popularly been used, though the amount of the toners to the carriers should be controlled, because they have the following advantages as compared with one-component type developers comprising magnetic toners without using any magnetic carrier; (1) triboelectrification of toners is readily controllable; (2) toner-cohesion is hardly producible; (3) toner-shift caused by a bias field or the like is effectively controllable; (4) toners are not necessarily contained in magnetic substances; (5) even if the toners need to contain such magnetic substances for preventing fog, it may be too little to contain and color clearness may be obtained when using color toners; (6) when rubbing the surface of an image forming member with a developer layer (i.e., when applying the so-called magnetic-brush method), toner ears are excellently produced by a magnetic brush and are excellent in rubbing property; (7) when the surface of an image forming member is cleaned with a magnetic brush, a satisfactory cleaning effect may be enjoyed.

Two-component developing methods have so far been improved one after another for the purpose of improving developability. As examples thereof, such a method is disclosed in, for example, U.S. Pat. No. 3,890,929, Japanese Patent O.P.I. Publication No. 18656/1980 wherein a development comprising a monocomponent type developer in an oscillatory electric field is applied to that made with a two-component type developer. More particularly, there has been disclosed the developing method wherein a two-component type developer comprised of toners and carriers is introduced between an image forming member (i.e., a member for supporting an electrostatically charged image) and a developing sleeve to develop the image (with or without contact) in an oscillatory electric field. This method is disclosed in, for example, Japanese Patent O.P.I. Publication Nos. 139761/1982, 147652/1982 and 147653/1982.

As compared with the developing methods wherein a monocomponent type developer is used in an oscillatory electric field, the difference of the above-given methods is appreciated from the point of view that no magnetic substance may be mixed in for deriving a transporting force of toner in itself from the magnetic substance. Additionally, the methods are suitable for color developments and the developing characteristics thereof may be more improved according to the variations of an oscillatory electric field. Furthermore, in Japanese Patent O.P.I. Publication No. 67565/1984 that was not laid open to the public when this application was originally filed, there is the disclosure of the developing characteristics obtained by making use of a two-component type developer comprising highly resistive toners and carriers.

Developing devices using such a developer as described above include, for example, those in which a developing sleeve is fixed while a magnet which is provided inside the sleeve and is arranged with a plurality of N, S magnetic poles to the direction of the circumference of the sleeve; those in which both developing sleeve and magnet are revolved together; and those in which such a developing sleeve as mentioned above is revolved while the magnetic poles inside the sleeve are fixed. Among them, those revolving the magnet inside the sleeve, like the first two examples, have the advantage that a developer layer formed on the surface of the developing sleeve is moved wavewise. Therefore, even if the thickness of the developer layer is somewhat uneven, any problems caused thereby may be offset by the wavelike movement of the layer. However, there is the disadvantage that the magnet is revolved at a high speed and, as a great turning effort is needed, vibration is apt to occur. Furthermore, the revolving mechanism has to be complicated, sturdy and large sized. On the other hand, in those having magnetic poles fixed inside, like the latter example, there is not such a problem as described in the revolving magnet example but there is the problem that, if the thickness of a developer layer is uneven, the influence thereof is apt to affect the performance because, when the developer layer is moved, a wavelike undulation is caused by the magnetic poles arranged inside the sleeve and, further, when the magnetic poles are arranged to the positions to the image forming member of the developing sleeve, the same influence is apt to be emphasized in accordance with the variations of a packing rate of the developer. There has, however, been almost no study or research of uniforming or thinning a developer layer in a developing area and, therefore, substantially higher quality image developing characteristics have not been satisfactorily achieved.

Thereafter Japanese Patent O.P.I. Publication No. 91453/1984 discloses a developing method wherein a development is performed by making use of a two-component type developer comprising ferrite carriers and toners in an oscillatory electric field. In this method too, however, the image quality obtained therefrom requires a bit of finishing touch for putting it to practical use.

Further, Japanese Patent O.P.I. Publication No. 121077/1984 discloses a system wherein a development is performed by making use of insulating carriers and toners in an oscillatory electric field. However, there is disclosed only a system in which a magnet roller is rotated inside a developing sleeve. This technique is, therefore, not fully satisfactory from the viewpoint of the stabilization of a developer layer.

This fact is not a serious problem as far as magnetic brush contact type development is concerned. However, this will seriously affect a non-contact type development in image quality, such as image density and the like, obtained therefrom.

Taking the above-mentioned points into consideration, Japanese Patent O.P.I. Publication No. 14263/1985, which was not laid open to the public at the time this application was filed, aims at achieving the uniformalization of a developer layer in such a manner that fixed magnetic poles are provided inside a developing sleeve so as not to form any ears in a developing area. In this case, the weak magnetic force restricts the carriers and conductive carriers and toners used therein to serve as a developer. With this technique, the developer will be broken down and the carriers of the developer will adhere to an image forming member and fogging will occur.

Prior to the present invention, the prior art used to require a finishing touch to put it into practical use and to obtain good image quality. Since the present invention was filed there wave been laid open to the public such techniques which cause fog or the like in the course of a developing process even though closer to the practically useful level. Besides the above, the pressing members are taught in Japanese Patent O.P.I. Publication No. 43027/1979 and 43028/1979 and the like. Additionally, it is particularly desirable to minimize the gap between an image forming member and a developing sleeve or the thickness of a developer layer on the developing sleeve. A substantially higher accuracy has been demanded for thinning such developer layers.

Accordingly, not only is such a pressing member to be provided but it is also required to be arranged in a proper position corresponding to the arrangements of the magnetic poles inside the developing sleeve.

SUMMARY OF THE INVENTION

1. Objects of the Invention

The development performed by making use of a two-component type developer in an oscillatory electric field may be understood according to the aforementioned publicly known example and the like. In the case of substantially adopting the developing device into manufactured articles, it has been necessary to perform careful study and research to make the device durable and reliable with use.

This patent application is to propose a developing device capable of displaying the practical advantages, based on the above-mentioned description. The principal objects of the invention will now be described in detail.

It is an object of the invention to provide an improved developing device in which a developing sleeve is revolved and magnetic poles are fixed to the inside of the developing sleeve so that the above-mentioned problem can be solved.

Another object of the invention is to provide a developing device capable of making the thickness of a developer layer even in a developing area where a developing sleeve is close to an image forming member, and therefore capable of performing a stable and uniform development, and capable of making compact in size without requiring any great revolving force and being hard to cause vibration.

2. Constitution of the Invention

This invention achieves the above-mentioned objects in the following constitution:

1. A two-component type developer comprised of the mixture of toners and magnetic carriers is to be used;

2. A developing sleeve is to be provided rotatably and face to face with an image forming member;

3. A magnetic pole is to be provided to the inside of the developing sleeve so as not to be in the closest position to the image forming member;

4. A development is to be made with the use of the developer on the developing sleeve in an oscillatory electric field while applying a horizontal magnetic field component to the developer layer;

5. A magnetic carrier is to be of a highly insulating type and is to have a resistivity of not less than $10^{13}$ Ωcm and more preferably not less than 10-Ωcm when measuring in a given method; and 6. A layer of the developer is formed over the developing sleeve so as to be moved as the sleeve is revolved.

This invention is made by satisfying the above-mentioned requirements. .

3. Effects of the Invention

Developing devices relating to this invention can display excellent effects. For example, the revolving mechanism is so simple that there is no possibility of causing vibration and every stable and sharp image can be reproduced without fog.

DETAILED DESCRIPTION OF THE INVENTION

This invention will be described with reference to the accompanying drawings.

Figure 1:
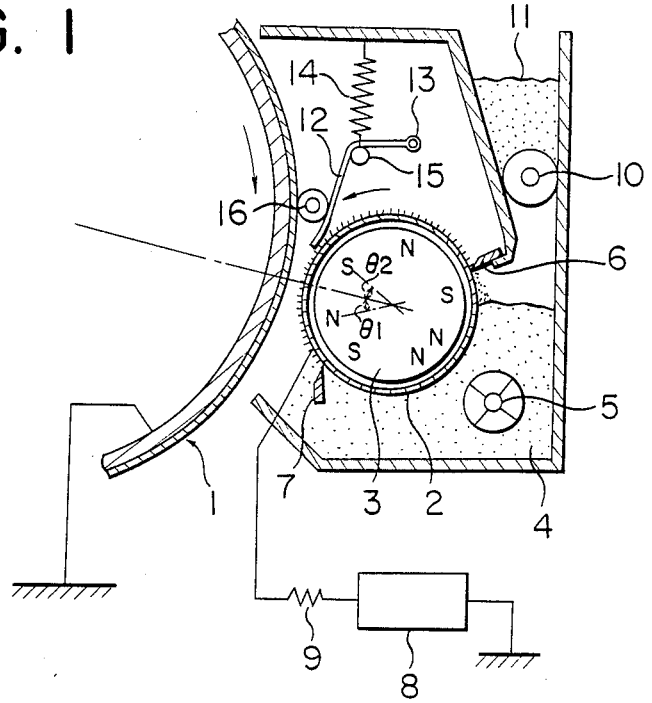
FIGS. 1 and 2 are partial illustrations of recording apparatuses in which an example of the developing device of this invention is shown.
Figure 2:
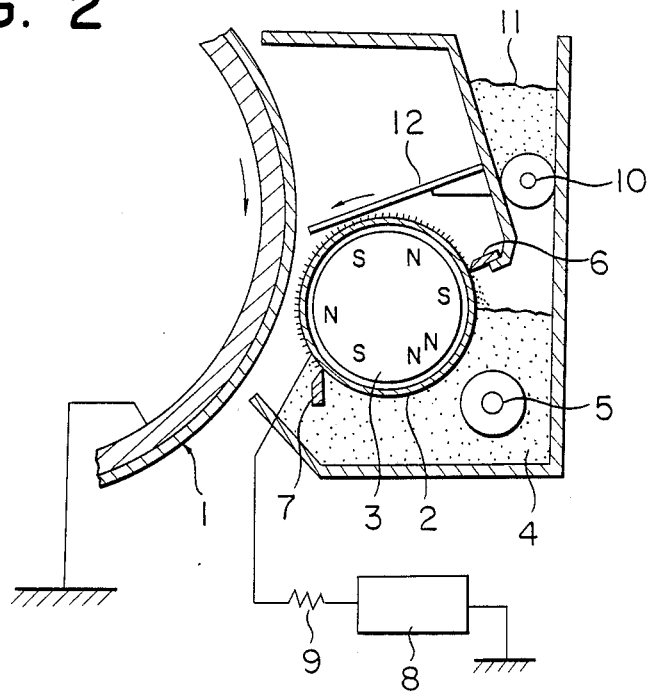

FIGS. 1 and 2 are partial illustrations of recording apparatuses, respectively, in which an example of the developing devices of this invention is shown.

FIGS. 3 through 6 are enlarged segmentary views, respectively, for illustrating a means so applied to developing device of this invention as to uniform the thickness of a developer layer in the developing area of each device.

Wherein, 1 is a drum-like image forming member having such an image forming layer as an electrophotosensitive receptor on the surface thereof and rotatable in the direction of the arrow so as to form an electrostatic latent image or the like; 2 is a developing sleeve rotatable in the direction of the arrow, which comprises such a non-magnetic conductive material as aluminium or stainless steel; 3 is a magnet fixed to the inside of developing sleeve 2 and arranged with a plurality of the N, S magnetic poles thereof to the circumferential direction of the sleeve, and such N, S magnetic poles are normally magnetized to a magnetic flux density of from 500 to 1,500 gauss; 4 is a developer reservoir; 5 is an impeller for agitating a developer comprising a mixture of toners and magnetic carriers in developer reservoir 4 so as to uniform the mixture thereof and for frictionally charging the toners; 6 is a layer thickness regulating blade comprising a magnetic or non-magnetic member for regulating the thickness of a developer layer formed when a developer inside the reservoir 4 is adsorbed onto the surface of developing sleeve 2 by magnetic force of the N, S magnetic poles of magnet 3 and is then moved to form the developer layer as the developing sleeve 2 is rotated; 7 is a cleaning blade by which, when developing sleeve 2 passes over a developing area close to image forming member 1, the developer layer is removed from the surface of the sleeve 2 to send back in the developer reservoir 4; 8 is a bias power source for applying a bias voltage to developing sleeve 2 through a safety resistor 9 so as to generate an oscillatory electric field between the sleeve 2 and image forming member 1 whose base is grounded and the toners are thereby controlled to move from the developer layer to the image forming member 1 in the developing area; 10 is a toner replenishing roller for replenishing toners from toner hopper 11 to developer reservoir 4.

The above-mentioned developing device is almost the same as the conventional ones having a fixed magnet 3, except that the arrangements of the N, S magnetic poles of magnet 3 are not the same. Even if the developer layer is regulated only by the layer thickness regulating blade 6 to uniform the thickness thereof, the thickness thereof is apt to be undulated. As in the conventional types of developing devices, if the magnetic poles are arranged to the closest positions to image forming member 1 of developing sleeve 2, it will become difficult to stably perform a development to obtain a satisfactory image density without fogs, because the developer layer comes into ear to emphasize the undulation of the layer thickness. When making the thickness of the developer layer thinner so as to bring the developer layer not into contact with image forming member 1, the gap between layer thickness regulating blade 6 and developing sleeve 2 should be made narrower. Therefore, clogs are apt to produce in the regulating area due to the cohesion of dusts, toners and the like.

Accordingly, in the developing devices of this invention, a horizontal magnetic field is formed in a developing area by arranging the N, S magnetic poles to the positions where are kept away from the position where the developing sleeve 2 is closest to the image forming member 1, so that the developer layer cannot come into ears but can be earless. It is, therefore, possible to perform a stable development without any influence of the undulation of the layer thickness, because, (1) in the developing area, the developer layer can be uniformed in thickness, and (2) in the developing area, a substantially thin developer layer can be realized even when widening the gap between layer thickness regulating blade 6 and developing sleeve 2.

With reference to FIG. 1, it is preferred to arrange the N, S magnetic poles to the positions where they are intercepted by an opening range of from 5 to 45 degrees from the center line between image forming member 1 and developing sleeve 2 and further preferred to make an opening angle $\theta_1$ on the downstream side of the center line and an opening angle $\theta_2$ on the upperstream side so as to be $\theta_1 \leqq \theta_2$. It is also preferred to increase the magnetic flux density of N (or S) magnetic poles arranged to the position of opening angle $\theta_1$ on the downstream side so that a ferromagnetic field can be generated on the downstream side of the developing area.

When using a two-component type developer, the carriers thereof may involve the risk of adhering to an image forming member. However, as described above, by intensifying the magnetic poles provided to the inside of a developing sleeve and corresponding to the lower stream side of a developing area, an advantage can be displayed such that the carriers adhering to a photoreceptor can be captured.

It is further preferred to decrease the diameter of developing sleeve 2 so as not to bring the ears of the developer layer into contact with the surface of image forming member 1 in the position of the N, S magnetic poles which are kept away from the position of the center line; the preferable range thereof being from 40 to 10 mmϕ. It is similarly preferred to decrease the diameter of image forming member 1 in a drum form, and the preferable range thereof is from 300 to 10 mmϕ. When using a bolt-like image forming member 1, it will be good enough to provide a belt drive roller into the developing area so as to satisfy the above-mentioned conditions.

In the developing devices shown in FIGS. 1 and 2, a pressure member 12 is further provided to this side before the developer layer reaches the position closest to image forming member 1 of developing sleeve 2, so as to apply a pressure onto the upper surface of the developer layer. To the position pressed thereby, an S (or N) magnetic pole is so arranged as to be opened by angle $\theta_2$ on the upperstream side of the center line. Therefore, the thickness of the developer layer can more uniformly be thinned in the developing area and can perform more stable developments having satisfactory image density without fog under the control of an oscillatory electric field. In addition, when an S (or N) magnetic pole is arranged by opening by angle $\theta_2$ onto the upperstream side of the center line between the center line and the pressing position of the pressure member 12, the developer layer will come roughly into ears by the magnetic field in the position of the magnetic pole, even if the thickness of the developer layer could be more uniformed by the pressure member 12. It is, therefore, preferred to lower the magnetic flux density of the magnetic pole to such a degree to not come into ears. A further description will be made later with reference to FIGS. 3 through 6.

Pressure member 12 shown in FIG. 1 is pivoted rotatably at the base end thereof by shaft 13, and is supported at the middle portion thereof by support bar 15 being lifted up by spring 14, and is then pressed by spacer roller 16 rotating to bring the backside of the leading edge thereof into contact with the surface edge of image forming member 1, and the upper surface of the developer layer is pressed by the surface of the leading edge.

Pressure member 12 shown in FIG. 2 is fixed at the base thereof to the frame of the developing device so as to press the upper surface of the developer layer by the surface of the leading edge of the pressure member 12. In FIG. 2, it is needless to say that the gap between developing sleeve 2 and the pressure member 12 can be adjusted by making the pressure member 12 of a suitably elastic material and pressing the back thereof by an adjust screw or the like. It is also the matter of course to press the pressure member 12 shown in FIG. 1 by an adjust screw or the like in place of the spacer roller 16.

Figure 3:
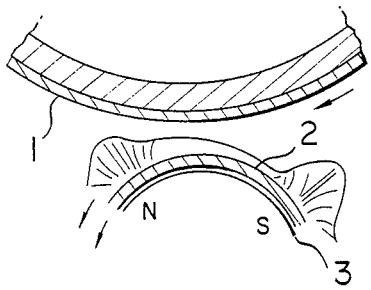
FIGS. 3 through 6 are enlarged segmentary views for illustrating a means applied to a developing device of this invention to uniform the thickness of a developer layer in the developing area of each device.

As in shown in FIG. 3, the developer layer formed over developing sleeve 2 will come into ears in a position where the N, S magnetic poles are arranged inside the sleeve 2. If there is any undulation in the thickness of the developer layer regulated by layer thickness regulating blade 6, such an undulation is apt to be emphasized in the positions where the developer layer comes into ears. Therefore, if N, S magnetic poles are provided to the position of the center line where developing sleeve 2 is closest to image forming member 1, there will seriously change the state where a brush rubs image forming member 1 so that fogs are apt to cause or an image is apt to get out of shape in a magnetic brush method; and in a non-contact developing method in which an image forming member is not brought into contact with a developer layer which hardly produces a fog or an image getting out, the developing sleeve 2 and the image forming member 1 are apt to come into contact with each other unless the gap between the developing sleeve 2 and the image forming member 1 is so widened enough as to be able to rotate magnet 3. Otherwise, a toner flying is not satisfactorily controlled in the oscillatory electric field, and uniform and satisfactory development density can hardly be obtained. In this invention, therefore, as shown in FIGS. 1 through 3, N, S magnetic poles are so arranged as to keep them away from the center line position where developing sleeve 2 is closest to image forming member 1, as to an improvement. Thereby, in the developing area, the magnetic field will have the horizontal (i.e., the tangential direction components and the developer layer will be formed thinly without coming into ears. A uniform and stable development can therefore be performed without emphasizing any undulation in layer thickness.

Figure 4:
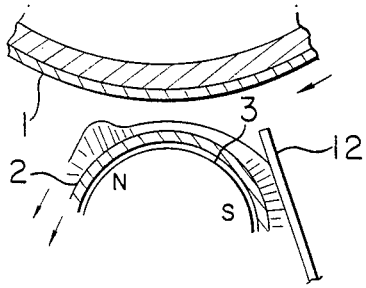
Figure 5:
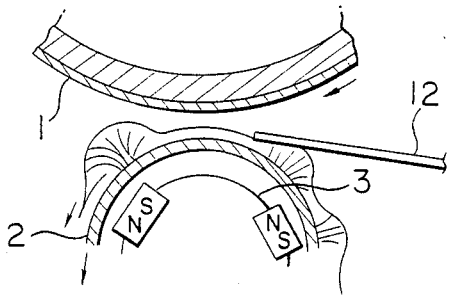
Figure 6:
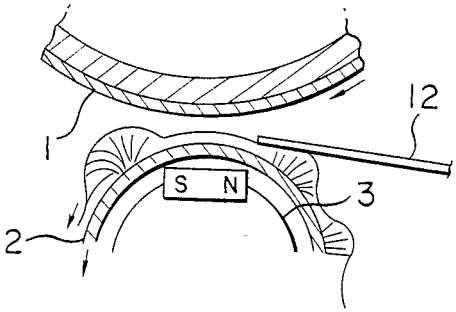

On the other hand, taking into consideration of a remedy for the undulation of a developer layer thickness by making use of a damming plate, a leveling plate or the like, it is effective to provide such a damming plate or leveling plate to a position where such an undulation is emphasized, so that the undulation can be remedied. However, the damming plate has less effects on the remedy for the undulated of a layer thickness regulated by a layer thickness regulating blade 6 with the similar purposes, and it is also difficult to provide it to this side near by a developing area. In contrast with the above, the leveling plate has such a feature that an undulation of a developer thickness can be remedied without remaining the developer unlevelled as in the case of using a damming plate and such a remedy can be achieved on this side near by the developing area. Therefore, as shown in FIG. 4, in a position of an S (or N) magnetic pole on the upperstream side from the center line between the N and S magnetic poles arranged respectively by keeping them away from the position where developing sleeve 2 is closest to image forming member 1, and when an undulation is leveled by pressing the upper surface of a developer layer with pressure member 12 (i.e., a leveling plate), then, it is possible to eliminate such a streak or a mottle as is caused by clogs of developer or dusts produced around layer thickness regulating blade 6, and it is also possible to uniform the thickness of the developer layer up to a remarkable degree, in a developing area. In the examples illustrated in FIGS. 1 and 2 or FIGS. 4 through 6, pressure members 12 were provided, respectively to such a position as mentioned above. In the examples illustrated in FIGS. 1 and 5, pressure members 12 were arranged respectively, so that the pressure point thereof can be positioned somewhat to the downstream side rather than the positions of S or N magnetic poles arranged to the upperstream side from the center line. In the examples illustrated in FIGS. 2 and 4, the pressure points were so provided, respectively, as to be above the S magnetic pole. Now, as shown in FIG. 5 or 6, in such a case that a magnet 3 comprises bar magnets held in juxtaposition with each other in the tangential direction, the position of a developer layer coming into ears is slightly shifted forward from the tips of the magnetic poles of a bar magnet. It is, therefore, preferred to adjust the pressure point of pressure member 12 to the shifted position. This is the reason why the pressure point of pressure member 12 shown in FIG. 5 was shifted to the downstream side from the N magnetic pole. This is the reason also why, in example shown in FIG. 6 in which bar magnets were arranged horizontally in a developing area, the pressure point of pressure member 12 was shifted to the upperstream side from the N magnetic pole.

It is preferred that pressure member 12 comprises an insulating material having an electrification series for promoting a charge generated by a friction of toners with carriers. Such pressure members 12 shall not be limited thereto, but may be those being supported in a floating state or being kept at the same voltage with a developer layer or developing sleeve 2 so as to prevent a discharge or leakage.

In a developing device of this invention, as described above, magnetic poles fixed to the inside of developing sleeve 2 are arranged to the positions being kept away from a position where the developing sleeve 2 is closest to image forming member 1 so that a developer layer moving as the developing sleeve 2 is rotated can be held upon receiving the action of horizontal magnetic field components in a developing area. Further, the upper surface of the developer layer is pressed by pressure member 12 and at the same time the thickness thereof is leveled before the developer layer reaches the above-mentioned closest position, therefore, the developer layer can be formed stably, uniformly and thinly. Consequently, in a magnetic brush method, there eliminates uneven development because a uniform rubbing can be performed with a magnetic brush; in a non-contact developing method, a gap between developing sleeve 2 and image forming member 1 can be narrowed so that a flying of toners can satisfactorily be controlled by an oscillatory electric field and it is, therefore, readily possible to develop images without fogs and in a high image density. Accordingly, a developing device of this invention can suitably be used in the non-contact developing method.

The following is a further description of the preferable conditions of the developments capable of reproducing sharp images without fogs in the case of using a developing device of this invention:

In a developing device of this invention, it is, of course, possible to use such a two-component-type developer as have so far popularly been used comprising non-magnetic toners of ten-odd μm in average particle size and magnetic carriers of from several tens μm to several hundreds μm in average particle size. However, according to this invention, as described above, any toners transfer can effectively be controlled by an oscillatory electric field and it is therefore preferred to use a two-component-type developer comrising toners of not larger than 10 μm in average particle size and carriers of not larger than 50 μm and more preferably not larger than 30 μm in average particle size. With reference to this particular point, such a two-component-type developer as described above is relatively coarse in the toner particles and also in the carrier particles thereof and it is therefore hard to obtain a high quality image to reproduce fine and delicate lines and dots or density gradation of the image. Accordingly, when making the average particle size of the toners smaller, the charged voltage of the toner particles is reduced qualitatively in proportion to a square of a particle size and such an adhesion force as Van der Waals force is relatively increased, so that the toner particles will become hard to separate from the carrier particles. And, in the magnetic brush method, when toners adhere once to non-image area of image forming member 1, they can not readily be removed even if they are rubbed by a magnetic brush, so that a fog is produced. In the magnetic brush method, this problem will become serious when the average size of toners becomes not larger than 10 μm. However, according to this invention, the above-mentioned problem can be solved by effectively controlling the movements of toners in an oscillatory electric field even in the magnetic brush method. To be concrete, toners adhering to a developer layer are separated therefrom by oscillation given electrically, so that the toners can readily be transferred to the surface of image forming member 1. When rubbing the surface of image forming member 1 with a magnetic brush, toner particles adhered to the non-image areas of image forming member 1 can readily be removed or transferred to the image areas thereof. In the non-contact developing method, nearly none of less charged toner particles is transferred to any non-image area, and any toner particles do not adhere to image forming member 1 because the surface of image forming member 1 is not rubbed to generate a frictional charge, therefore toner particles up to the order of 1 μm in size may be used. In the magnetic brush developing method as well as in the non-contact developing method, it is possible to obtain an excellently reproducible and clear-cut toner image developer with fidelity from a latent image. In addition to the above, an oscillatory electric field will weaker a bonding of toner particles with carrier particles, therefore, adhesion of carrier particles to image forming member 1 accompanied by toner particles is also reduced. In the non-contact developing method, in particular, greatly charged toner particles are oscillated under the oscillatory electric field in the iamge areas and non-image areas and carrier particles are also oscillated according to the intensity of the electric field. Thereby, the toner particles will selectively be transferred to the image areas of the surface of image forming member 1. Therefore, the adhesion of the carrier particles to the surface of image forming member 1 may sharply be reduced. In this instance, however, there may cause such a problem that the toner particles being oscillated in the non-image areas are apt to fly around according to the intensity of the electric field. The same problem is raised also in the case of the carrier particles. This problem can be prevented by making the revolution of developing sleeve 2 slower to properly slow down the transport speed of the developer layer.

On the othe hand, when the average size of toner is getting large, the roughness in an image will become striking as described previously. In a development for resolving a group of juxtaposed fine lines with a pitch of the order of 10 lines per mm, toners of the order of 20 μm in average particle size may normally have no problem in practical use. When using fine-grained toners of not larger than 10 μm in average particle size, the resolving power thereof will much be improved to bring out a sharp and high quality image in which the variable density and the like can be reproduced with fidelity. From the reasons mentioned above, the proper requirements for toner sizes are not larger than 20 μm in average particle size and more preferably not larger than 10 μm. And, in order that toner particles should follow up an oscillatory electric field, it is desired that the average charged volume of toner particles is not smaller than 1–3 μC per gram. In particular, a relatively high charged volume is essential in the case of small particle size.

Such toners as described above can be prepared as same as in the preparation of conventional toners. In other words, there may use such globular or amorphous and non-magnetic or magnetic toner particles as selected from toners of the prior art by making use of an average particle size selecting means. Among them, it is preferred that the toner particles are magnetic particles containing the particles of magnetic substance, and in particular, those containing magnetic fine particles in the quantity of not larger than 60% by weight of the total quantity of the toner particles. When such toner particles are magnetic particles, the uniformity thereof can be more improved and the flying thereof is hardly be caused and further fog is prevented from occurring, because the toners are also influenced by the N, S magnetic poles of magnet 3. However, when the quantity of such magnetic substance is too much increased in the contents of the toners, a satisfactory development density cannot be obtained because the magnetic force generated between the toner particles and carrier particles is also too much increased, and a frictional charge will become difficult to control or the toner particles are apt to be broken or further a cohesion is apt to be produced between the toner particles and the carrier particles because the fine particles of the magnetic substance will appear on the surface of the toner particles. In particular, in the case of other color toners than those in black or brown, any sharp and clear color cannot be obtained unless the quantity of the magnetic substance is descreased to not more than 30% by weight.

To sum up the above description, the preferred toners can be prepared in such a manner that a resin such as a styrene resin, a vinyl resin, an ethylic resin, a resin denatured resin, an acrylic resin, a polyamide resin, an epoxy resin, a polyester resin and the like, and the fine particles of a magnetic substance are used and further to which such a coloring component as carbon and the like and an electrostatic controlling agent if necessary are added, so as to apply a process smilar to the toner particle preparation processes of the prior art; and such a preferred toner comprises particles of not larger than 20 μm in average particle size and more preferably those of not larger than 10 μm. Further, when toner particles are globulized either in a spray-dry process or in a globulization process applied after making the toners in the particle form, the developer is improved in the fluidity thereof so as not to cohere, and the uniformly mixing property thereof with carriers, the transferability and the chargeability thereof are also improved.

Now, with reference to magnetic carriers, when they are relatively large in average particle size, such a problem as is hard to develop an image in a high density may be raised, because (1) a developer layer formed on developing sleeve 2 becomes coarse and an unevenness is therefore produced in a toner image even if a latent image is developed as a series of oscillations is applied thereto with an oscillatory electric field, and (2) the toner density is lowered in the developer layer, therefore, a high density developement will become difficult to perform. And, according to the results of our experiments, the above-mentioned problems are effectively getting decreased when average particle size is not larger than 50 μm, and the problems are substantially solved when it is not larger than 30 μm. However, if the carrier particles are too fine, (3) they tend to adhere together with the toner particles to the surface of image forming member 1, and (4) they tend to fly around. In these development processes, in general, the above-mentioned tendencies will gradually begin to appear when the carriers will become not larger than 15 μm in average particle size, and the tendencies will be apparent when they will become not larger than 5 μm. The carrier particles adhered to the surface of image forming member 1 are to partly be transferred together with toners onto a sheet of recording paper and the rest thereof are to be removed together with the remaining toners from the surface of image forming member, by a cleaning means comprising a blade, fur-brush or the like. However, with carrier particles consisting of magnetic substances of the prior art, there are such problems as that (5) the carrier particles transferred to a recording paper cannot be fixed thereon by themselves, therefore, they are apt to drop out of the recording paper, and that (6) when the carrier particles remaining on image forming member 1 are removed therefrom by the cleaning means, the surface of image forming member 1 comprising a photoreceptor is apt to be damaged.

These problems (5) and (6) can be solved by forming magnetic carrier particles as well as a substance such as a resin or the like capable of fixing both of them onto a sheet of recording paper. To be more concrete, magnetic carrier particles are formed of the particles of magnetic substance covered with the substance capable of fixing the magnetic carrier particles onto a recording paper, or are formed of the substance capable of fixing the magnetic carrier particles onto a recording paper, which dispersively contain the powder of the magnetic substance, and the carrier particles adhered to the recording paper are then also fixed by heat or pressure; and when the carrier particles are removed from image forming member 1 by the cleaning means, the surface of image forming member 1 will not be damaged. In such magnetic carrier particles as mentioned above, the above-mentioned problem (3) will cause almost no trouble in practical use, even if the carrier particles should transfer onto image forming member 1 or a recording paper when the size of the carrier particles are taken not larger than 5 to 15 μm in average. And yet, when such a carrier adhesion as the problem (3) is caused, it is effective to provide a recycling mechanism.

From the points as mentioned above, the proper conditions of magnetic carrier are that the average particle size thereof is not larger than 50 μm and preferably from not larger than 30 μm to not smaller than 5 μm; and it is preferred that the magnetic carriers also contain the substance capable of fixing the magnetic carrier particles onto a recording paper. Such an average particle size is an average particle size determined by weight as is similar to the case of toners, and is determined by means of a Coulter Counter manufactured by Coulter Co., or an Ominicon Alpha manufactured by Bosch & Romb Co.

Such magnetic carriers can be obtained by selecting the particle size thereof by an average particle size selecting means of the prior art from the following particles; (a) those of such a metal as iron, chromium, nickel, cobalt or the like, the compounds thereof or the alloys thereof as are used in the conventional magnetic carrier particles, including for example those of ferromagnetic substance or a paramagnetic substance such as triiron tetraoxide, γ-ferric oxide, chromium dioxide, manganese oxide, ferrite, and a manganese-copper alloy; (b) those covered over the surface of the magnetic substance particles thereof with such a resin as described in the previous case of the toners, or with such a fatty-acid wax as palmitic acid wax, stearic-acid wax or the like; or (c) those comprising a resin or a fatty-acid wax containing dispersed fine magnetic particles.

Besides the effects previously described, there can be enjoyed such an effect that a uniform developer layer can be formed on developing sleeve 2 and a high intensity bias voltage can also be applied to the developing sleeve 2, when carrier particles are formed of resins or the like and preferably they are made in the globular form. In other words, what are meant that the carrier particles are made of resins or the like are that it is possible to display such effects (1) that the developer layer can uniformly be formed and a low-resistive area or an uneven thickness of the layer can be prevented from locally producing because there eliminates, in general, such an orientation that a magnetic adsorption is apt to occur in the direction of the major axis, and (2) that a concentration of electric field into an edge portion is not taken place because such an edge portion as those experienced in the conventional carrier particles can be eliminated and made highly resistive so that, consequently, an electrostatic latent image cannot be disordered by discharging electricity to image forming member 1 or the bias voltage cannot be broken down, even when applying a high intensity bias voltage to developing sleeve 2. What is meant by "a high intensity bias voltage can be applied" is that, when a development is made under the oscillatory electric field relating to this invention by applying an oscillating bias voltage, the effects can satisfactorily be enjoyed.

As for the carrier particles capable of displaying such effects as mentioned above, such waxes as above-mentioned can be used. However, from the viewpoints of the durablity of carriers, it is preferred to use such resins as mentioned above.

There is also a developing method wherein, for example, the already-mentioned ferrite carriers are used. However, according to the studies and research concerning this invention a level of $10^8$ Ωcm in resistivity may be obtained when using a naked ferrite. It was found out that, on this level of resistivity, although a better image quality than the conventional image quality can be developed, the high insulating property of the invention can hardly be obtained. At this level of resistivity, there may be the risk of occurrences of injections of electric charge into carriers and this risk will lead to an adhesion of the carriers to an image forming member, though such adhesion may be in a small amount.

To perform a two-component type development in an oscillatory electric field, it is desirable to apply a relatively greater oscillatory electric field. If that is the case, a leakage of electric charge or an adhesion of the above-mentioned carriers to an image forming member will occur unless a carrier resistivity is made satisfactorily higher.

In addition, it is preferred to use those having formed insulating magnetic particles not lower than $10^{-}$Ωcm. This resistivity is a value obtained in such a manner that particles are put in a vessel having the cross-sectional area of 0.50 $cm^2$ and a load of 1 $kg/cm^2$ is applied over the particles packed upon tapping. When applying a voltage capable of generating an electric field of 1000 V/cm between the load and an electric pole on the base of the vessel, an electric current value is read. It was discovered from the various experiments that, if this resistivity is low, carrier particles are charged so that the carrier particles are apt to adhere to image forming member 1 or a bias voltage is apt to be broken down when the bias voltage is applied to developing sleeve 2. Accordingly, it was discovered that such a defect can be eliminated by making use of carrier particles having an insulating property of not less than $10^{13}$ Ωcm (hereinafter called a high insulating property of the invention) as described above.

This discovery cannot be determined form the conventional concept that a resistivity would be good enough if it is not less than $10^8$ Ωcm. Additionally, it is hardly obvious that no carrier break-down would occur, provided that the carriers are of the "high insulating property of the invention.

Therefore, the proper requirements for such magnetic carriers are that, besides the requirements provided for the average particle size thereof, the particles thereof are to be so globed as to be not more than three times the ratio of the major axis to the minor axis so that such a protrusion in a needle-shaped or an edge-shape may not be produced and better images may be obtained than conventional images, provided that the resistivity thereof is not less than $10^8$ Ωcm. However, there is still the risk of occurring problems as mentioned above. It is a proper condition for the present invention that the resistivity thereof is not less than $10^{13}$ Ωcm. And, it is more preferred that the resistivity is not less than $10^{14}$ Ωcm, as will be described in the example given later. And, in such carriers made of magnetic particles or covered with resins each of which is made highly resistive and in globular form, such magnetic carrier particles are to be selected from those which are as globular as possible and are to be covered with resins. In such carriers in which the fine particles of magnetic substances are dispersed, particles as fine as possible are to be formed in dispersed resin particles and then globed or such dispersed resin particles are to be prepared in a spray-dry process. Thus, such magnetic carrier particles are prepared.

In a developing device of this invention, it is preferred to use a developer in which such toners and magnetic carriers as described above are mixed up in the same proportion as the proportion thereof in the conventional two-component type developers. In particular, in the case of a development to be made under the non-contact developing conditions, even an extremely high density of the order of 10% to 80% can be applied.

To a developer may be mixed, if occasion demands, with a cleaning agent or the like serviceable for cleaning the surface of image forming member 1 and a fluidizing agent for improving the fluidizing and slipperiness of the particles. As for the fluidizing agents, a colloidal silica, a silicon varnish, a metallic soap, a non-ionic surface active agent or the like may be used, and, as for the cleaning agents, a fatty-acid metal salt, an organic-group-substituted silicon, a fluorine surface active agent or the like may be used.

The abovementioned are the requirements for such developers. Now, with reference to the requirements for developing an electrostatic latent image registered on image forming member 1 by forming a developer layer with such a developer as described above, it is preferred to provide a gap of several tens μm to 2,000 μm between developing sleeve 2 and image forming member 1, and if the gap is narrower than several tens μm, it will become hard to form a developer layer capable of uniformly processing a development, and to supply a satisfactory amount of toners to a developing area, therefore, any stable development will not be carried out. On the contrary, if the gap exceeds greatly over 2,000 μm, the opposed electric pole effect will be lowered and a satisfactory development density will not be obtainable. When the gap is provided within the range of several tens μm to 2,000 μm, the developer layer can uniformly be formed in a suitable thickness. It is, accordingly, preferred to provide such conditions that the developer layer is not brought into contact with the surface of image forming member 1 in the state that the gap and the thickness of developer layer are so provided as not to generate any oscillatory electric field when forming a non-image area but to make the developer layer closer as much as possible to the surface of developing layer. Thereby, a sweeping streak or a fog can be prevented from occurring on a toner image. A position of developing sleeve 2 to be made closer to image forming member 1 is preferably to be set so as to point gravity to the developing sleeve 2, for the purpose of preventing toners or the like from scattering. It is needless to say that the invention shall not be limited thereto. From the point of preventing toners or the like from scattering, it is preferred that the speed and direction of revolution of developing sleeve 2 may be relatively slow and in the direction opposite to the direction of the movement of image forming member 1, however, from the point of an image reproductivity on a developer layer, it is preferred that the speed and direction thereof may be nearly the same with or faster than that of image forming member 1 and the same direction as in the direction of the movement of the image forming member 1. It is, therefore, preferred that the peripheral speed of developing sleeve 2 may be kept within the range of 4 to 5 times faster than that of image forming member 1 and may also be in the same direction. It is, however, to be understood that the invention shall not be limited thereto.

It is desired that a development under an oscillatory electric field may be carried out by applying from bias power source 8 to developing sleeve 2 with a voltage overlapped a direct current voltage relating to a fog prevention and a development density with an alternative current voltage relating to the development density and gradation so as to generate an oscillatory electric field in a developing area. The d.c. components thereof to be used are as almost same as or within the range of from 50 to 600 V that is higher than the voltage in the non-image area of image forming member 1. As for the preferable a.c. components thereof, those having a frequency of 100 Hz or more preferably, 1 to 5 KHz, and an amplitude within the range of 100 to 5,000 V are used. The a.c. components may be lower than the voltage in the non-image area when the toner is a magnetic toner. If the frequency of such a.c. components is too low, an oscillation pitch will tend to appear in a developing process, and or the contrary if it is too high, the developer will tend to be unable to follow the oscillation of the electric field and lower the development density so that a sharp and high quality image may not be obtained.

The amplitude of such a.c. components depends upon a frequency thereof. However, the greater the amplitude is, the more the oscillation of a developer layer is made, and the effects of the oscillation will get increased. On the other hand, the greater the amplitude is, the more fogs are apt to produce and such a dielectric breakdown as a thunderbolt phenomenon is also apt to take place. When the carrier particles of a developer are insulated with resins or the like, or are further globed, such a dielectric breakdown may be prevented and any fog may also be prevented from occurring by such a.c. components. It may further be allowed to insulate or semi-insulate the surface of developing sleeve 2 by coating thereon with a resin or an oxidized coating layer. It may still further be allowed to improve the transferability of the developer layer by providing unevenness onto the surface.

According to a developing device of the invention, an excellently image-resolving, sharp and stable development without any fog can be performed by applying the above-mentioned developer and developing requirements. This invention shall not be limited to the example in which an oscillatory electric field is generated by applying an oscillatory voltage to developing sleeve 2, there may also be other examples such as that in which several lines of electrode wires are stretched around a developing area with the intervals of 100 to 200 μm between developing sleeve 2 and image forming member 1 or an electrode net with openings of 100 to 2,000 μm is stretched therebetween, to which an oscillation voltage is applied so as to generate an oscillatory electric field in the developing area and the flying of toners is controlled thereby. Also in these cases, it is allowed to apply a a.c. bias voltage to developing sleeve 2 or to apply an oscillation voltage of a different oscillation frequency.

Any developing devices of this invention may also be used in a reversal development process. In this case, the d.c. components of a bias voltage are to be set as to be nearly the same as a voltage received in the non-image background of image forming member 1. In addition to the above, any developing devices of this invention may be served as the developing devices of not only an electrophotographic recording means but also an electrostatic recording means using multistylus electrodes and a magnetic recording means. Further, they are suitably used in a color-image recording means for forming a color-image by superposing one toner image on another. It is the matter of course to use magnetic toners for developing a magnetic latent image in a magnetic recording process.

Now, referring to the following concrete examples of this invention;

EXAMPLE 1

There used the magnetic particles to serve as the carrier particles treated in a heat globing process in which 50% by weight of fine grained ferrites were dispersed in resins so as to be 20 μm in the average particle size, 30 emu/g in magnetization and $10^{14}$ Ωcm or more in resistivity; and there used the non-magnetic particles to serve as the toner particles of 5 μm in the average particle size. Then, a development was tried with such a developing device as shown in FIG. 1 and under the conditions to make the proportion of the toner particles to the carrier particles be 15% by weight in a developer reservoir 4. The average quantity charged of the toners was −15 μC/g.

Image forming member 1 has an a-Si photoreceptor layer on the surface thereof and the peripheral speed thereof is 180 mm/sec. in the direction of the arrow. An electrostatic latent image of 500 V in a maximum voltage and 100 V in a minimum voltage is formed on the surface.

There arranged the outside diameter of developing sleeve 2 to be 30 mm, the gap between the surface thereof and image forming member 1 to be 0.7 mm (i.e., 700 μm), and the revolution in the direction of the arrow to be 150 rpm. In magnet 3, the magnetic flux density were set to 1,200 gauss at the magnetic pole on the downstream side of the developing area and 500 gauss at the other magnetic poles, respectively.

Pressure member 12 comprises a polyethyleneterephthalate plate of 50 μm in thickness and the pressure member 12 regulates the developer layer to be pressed thereby immediately before entering into a developing area so that the thickness of the developer layer can be about 0.4 mm. That is, the development was made in a non-contact developing process. A d.c. component of 200 V was applied to developing sleeve 2, while the developing device and image forming member 1 were driven simultaneously, and in developing, a bias voltage comprising a 200 V d.c. component and an a.c. component of 2 KHz and 1,000 V was applied from bias power source 8 to developing sleeve 2. However, the bias voltage was applied thereto only in the developing process, and after developed only the 200 V d.c. component was applied to the developing sleeve 2. After all the processes were completed, the developing device and image forming member 1 were stopped in driving and at the same time the d.c. components was also stopped in applying to the developing sleeve 2.

The development was carried out under the above-mentioned conditions, and the developed image was transferred onto a sheet of plain paper by applying a corona discharge and the transferred image was then fixed through a heat-roller type fixing device whose surface temperature was at 140° C. Resultantly, the image obtained on the recording paper was high in density and excellent in sharpness without any edge effect and any fog. After that, 50,000 copies were obtained, and they were proved to be stable and uniform in image quality from the first copy upto the last.

EXAMPLE 2

There used the magnetic particles to serve as the carrier particles treated in a heat globing process in which 50% by weight of fine grained ferrites were dispersed in resins so as to be 20 μm in the average particle size, 30 emu/g in magnetization and $10^{14}$ Ωcm or more in resistivity; and there used the non-magnetic particles to serve as the toner particles of 5 μm in the average particle size. Then, a development was tried with such a developing device as shown in FIG. 2 and under the conditions to make the proportion of the toner particles to the carrier particles to be 30% by weight in a developer inside developer reservoir 4. The average quantity charged of the toners was −5 μC/g.

The requirements for image forming member 1 and the outside diameter of developing sleeve 2 were the same as in the Example 1, and the gap between the surface thereof and image forming member 1 to be 1.2 mm (i.e., 1,200 μm), and the revolution in the direction of the arrow to be 100 rpm. In magnet 3, the magnetic flux density were set to 1,000 gauss at the magnetic pole on the downstream side of the developing area as well as at the other magnetic poles; respectively.

Pressure member 12 comprises a resin-coated phosphor bronze plate of 200 μm in thickness and the pressure member 12 regulates the developer layer to be pressed thereby immediately before entering into a developing area so that the thickness of the developer layer can be about 0.6 mm. That is, the development was also made in a non-contact developing process. In developing, a bias voltage comprising a 200 V d.c. component and an a.c. component of 4 KHz and 2,000 V was applied from bias power source 8 to developing sleeve 2.

The development was carried out under the above-mentioned conditions, and the developed image was transferred onto a sheet of plain paper by applying a corona discharge and the transferred image was then fixed through a heat-roller type fixing device whose surface temperature was at 140° C. Resultantly, the image obtained on the recording paper was high in density and excellent in sharpness without any edge effect and any fog, and was more excellent in resolving power and higher in density as compared with the image obtained in Example 1.

After that, 50,000 copies were obtained, and they were proved to be stable and uniform in image quality from the first copy upto the last.

What is claimed is:

1. A developing means for developing, in an oscillatory electric field, a latent image formed on an image forming member comprising a two-component type developer wherein a mixture of toners and magnetic carriers is used, a developing sleeve having fixed magnetic poles therein, said developing sleeve being provided to face with said image forming member, said developer being arranged to move on said developing sleeve according to the rotation of said sleeve, said magnetic poles being arranged so as not to be in the nearest position to said image forming member, and said magnetic carriers having a resistivity of not less than $10^{13}$ Ωcm measured by reading an electric current value obtained in the manner that the carrier particles are put in a vessel having a sectional area of 0.5 $cm^2$ and tapped, and a load of 1 $kg/cm^2$ is applied onto the packed particles and a voltage is applied between the load and a bottom electrode so as to generate an electric field of 1000 V/cm.

2. A developing means as claimed in claim 1, wherein said magnetic carriers have a resistivity of not less than $10^{14}$ Ωcm under said measurement conditions.

3. A developing means as claimed in claim 1, wherein said developer on said developing sleeve is made thinner than the gap between said image forming member and said developing sleeve.

4. A developing means as claimed in claim 2, wherein said developer on said developing sleeve is made thinner than the gap between said image forming member and said developing sleeve.

5. A developing means as claimed in claim 1, wherein said magnetic carriers have a spherical configuration.

6. A developing means as claimed in claim 5, wherein said magnetic carriers are prepared by applying a resin-coating treatment to the spherical particles of a magnetic substance.

7. A developing means as claimed in claim 5, wherein said magnetic carriers are prepared by applying a sphering treatment to magnetic particles dispersed in a resin.

8. A developing means as claimed in claim 5, wherein said magnetic carriers have a resistivity of not less than $10^{14}$ Ωcm under said measurement conditions.

9. A developing means as claimed in claim 5, wherein said developer on said developing sleeve is made thinner than the gap between said image forming member and said developing sleeve.

10. A developing means as claimed in claim 8, wherein said developer on said developing sleeve is made thinner than the gap between said image forming member and said developing sleeve.

11. A developing means as claimed in claim 1, wherein a pressing member for pressing the upper surface of said developer on said developing sleeve is provided to press down said developer in a position of at least one of said magnetic poles arranged on the inside of said developing sleeve.

12. A developing means as claimed in claim 11, wherein said magnetic carriers have a resistivity of not less than $10^{14}$ Ωcm under said measurement conditions.

13. A developing means as claimed in claim 11, wherein said developers on said developing sleeve are made thinner than the gap between said image forming member and said developing sleeve.

14. A developing means as claimed in claim 12, wherein said developers on said developing sleeve are made thinner than the gap between said image forming member and said developing sleeve.

15. A developing means as claimed in claim 1, wherein at least one of said magnetic poles is arranged to be within an angle of 5° to 45° of the line connected from the center of said image forming member to the center of said developing sleeve.

16. A developing means as claimed in claim 15, wherein said magnetic carriers have a resistivity of not less than $10^{14}$ Ωcm under said measurement conditions.

17. A developing means as claimed in claim 15, wherein said developers on said developing sleeve are made thinner than the gap between said image forming member and said developing sleeve.

18. A developing means as claimed in claim 16, wherein said developers on said developing sleeve are made thinner than the gap between said image forming member and said developing sleeve.

19. The developing means as claimed in claim 1, wherein two of said magnetic poles arranged closest to the line connected from the center of said image forming member to the center of said developing sleeve are of a different polarity from each other and are arranged so as to correspond to upper and lower streams of a developing area and open angles of the magnetic poles arranged to the upper stream side are made wider than open angles of the magnetic poles arranged to the lower stream side with respect to the line connecting the center of said image forming member to the center of said developing sleeve.

20. A developing means as claimed in claim 19, wherein said magnetic carriers have a resistivity of not less than $10^{14}$ Ωcm under said measurement conditions.

21. A developing means as claimed in claim 19, wherein said developers on said developing sleeve are made thinner than the gap between said image forming member and said developing sleeve.

22. A developing means as claimed in claim 20, wherein said developers on said developing sleeve are made thinner than the gap between said image forming member and said developing sleeve.

23. A developing means as claimed in claim 19, wherein a magnetic flux density of said magnetic poles on the lower stream side are made greater than a magnetic flux density of said magnetic poles on the upper stream side.

24. A developing means as claimed in claim 23, wherein said magnetic carriers have a resistivity of not less than $10^{14}$ Ωcm under said measurement conditions.

25. A developing means as claimed in claim 23, wherein said developers on said developing sleeve are made thinner than the gap between said image forming member and said developing sleeve.

26. A developing means as claimed in claim 24, wherein said developers on said developing sleeve are made thinner than the gap between said image forming member and said developing sleeve.

* * * * *